US011114792B2

(12) United States Patent
Shindo

(10) Patent No.: US 11,114,792 B2
(45) Date of Patent: Sep. 7, 2021

(54) CONTACT AND CONNECTOR

(71) Applicant: Tyco Electronics Japan G.K., Kawasaki (JP)

(72) Inventor: Yoshihiko Shindo, Kawasaki (JP)

(73) Assignee: Tyco Electronics Japan G.K., Kawasaki (JP)

( * ) Notice: Subject to any disclaimer, the term of this patent is extended or adjusted under 35 U.S.C. 154(b) by 0 days.

(21) Appl. No.: 16/721,985

(22) Filed: Dec. 20, 2019

(65) Prior Publication Data

US 2020/0203876 A1 Jun. 25, 2020

(30) Foreign Application Priority Data

Dec. 21, 2018 (JP) ..... JP2018-239179

(51) Int. Cl.
*H01R 13/432* (2006.01)

(52) U.S. Cl.
CPC ..... *H01R 13/432* (2013.01)

(58) Field of Classification Search
CPC ..... H01R 13/432
See application file for complete search history.

(56) References Cited

U.S. PATENT DOCUMENTS 9,039,447 B2 * 5/2015 Aoki ..... H01R 13/432 439/607.01

FOREIGN PATENT DOCUMENTS

| | | | |
|---|---|---|---|
| DE | 102011089307 | A1 | 6/2013 |
| FR | 3044172 | A1 | 11/2020 |
| JP | 3-147282 | A | 6/1991 |
| JP | 2002280106 | A | 9/2002 |
| JP | 2015-111569 | A | 6/2015 |

OTHER PUBLICATIONS

European Search Report, dated Apr. 28, 2020, 9 pages.

* cited by examiner

*Primary Examiner* — Ross N Gushi
(74) *Attorney, Agent, or Firm* — Barley Snyder

(57) ABSTRACT

A contact includes a pair of side walls, a front end upper wall extending from the side walls, a rear end upper wall extending from the side walls, a lance extending in a rearward direction from a rear end of the front end upper wall, and an extension piece extending in the rearward direction from a rear end portion of the lance. The lance has a catch portion at the rear end portion of the lance. The catch portion is caught in a housing when the contact is inserted into the housing. The extension piece is positioned under the rear end upper wall.

22 Claims, 3 Drawing Sheets

CONTACT AND CONNECTOR

CROSS-REFERENCE TO RELATED APPLICATION

This application claims the benefit of the filing date under 35 U.S.C. § 119(a)-(d) of Japanese Patent Application No. 2018-239179, filed on Dec. 21, 2018.

FIELD OF THE INVENTION

The present invention relates to a contact and, more particularly, to a contact having a lance.

BACKGROUND

A contact of a connector can have a lance. The lance has a fixed end at the front of a direction of insertion of the contact into a connector housing and a cantilever shape that extends rearward. The lance has a free end at the rear and an engaging portion that engages with the connector housing. An electric wire, for example, can be connected to the contact. When a rearward pull-out force is applied to the electric wire, the engaging portion abuts against the connector housing and prevents the contact from being pulled out.

Because the lance has a cantilever shape, the electric wire, for example, can easily get under the lance from the free end, and the electric wire under the lance may snag on the lance and cause accidental deformation of the lance.

Japanese Patent No. 3-147282A discloses a contact having a structure in which a free end of a lance is extended to be positioned under an upper wall of the contact. This structure prevents an electric wire or the like from getting under the lance, thus reducing accidental deformation of the lance. In the structure disclosed in JP 3-147282A, however, the lance is formed by folding back rearward a beam that extends forward from an upper wall of the contact. Consequently, the yield of a material of contacts is low and only a small number of contacts can be produced per unit area of a plate of the material.

SUMMARY

A contact includes a pair of side walls, a front end upper wall extending from the side walls, a rear end upper wall extending from the side walls, a lance extending in a rearward direction from a rear end of the front end upper wall, and an extension piece extending in the rearward direction from a rear end portion of the lance. The lance has a catch portion at the rear end portion of the lance. The catch portion is caught in a housing when the contact is inserted into the housing. The extension piece is positioned under the rear end upper wall.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
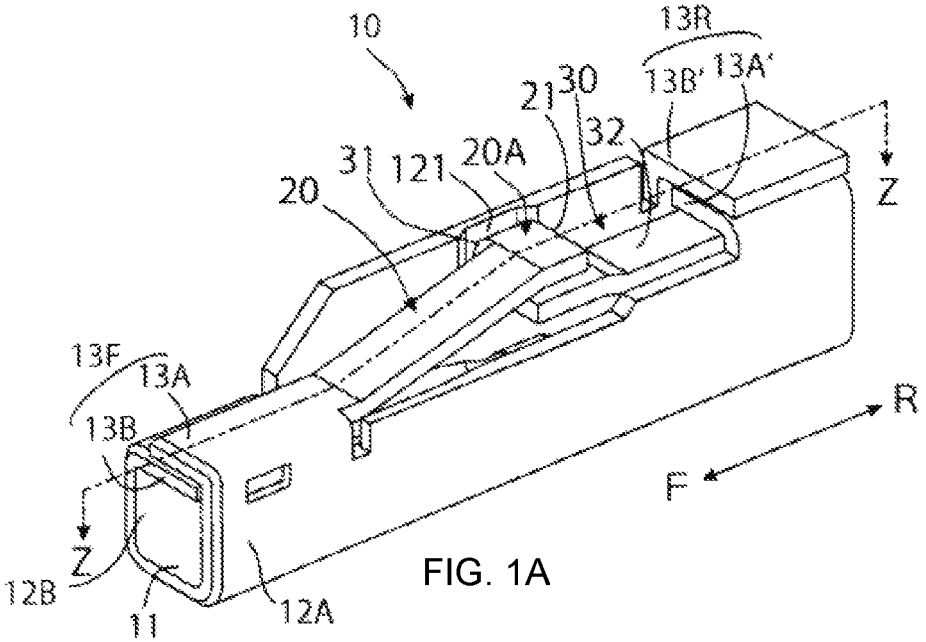
FIG. 1A is a front perspective view of a contact according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art.

Figure 1B:
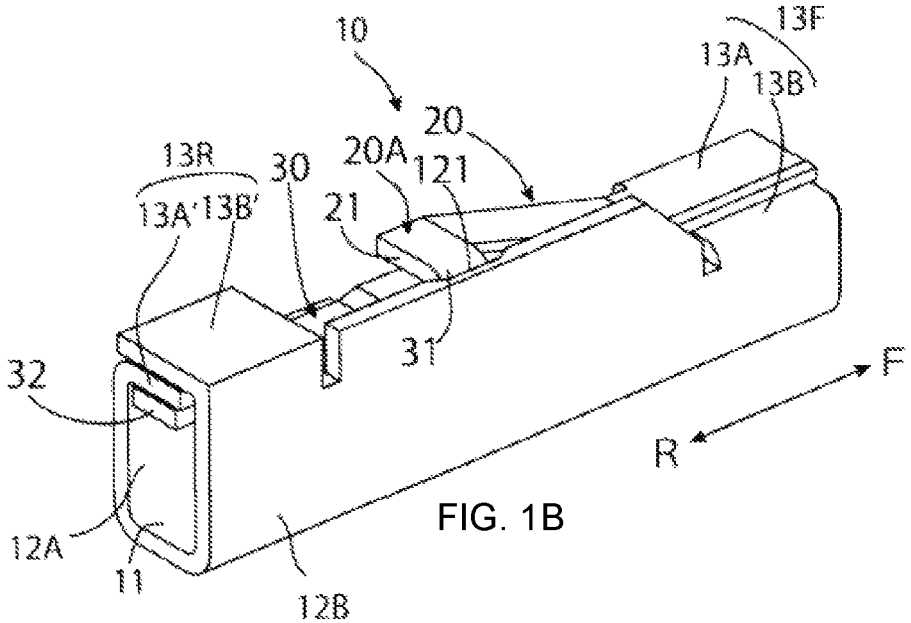
FIG. 1B is a rear perspective view of the contact of FIG. 1A.

A contact 10 according to an embodiment is shown in FIGS. 1A and 1B. The contact 10 has an electric wire connecting terminal, located at a rear R, that is connected to an electric wire. The contact 10 is inserted into a connector housing in a frontward direction F.

The contact 10, as shown in FIGS. 1A-3C, has a bottom wall 11, a pair of side walls 12A, 12B, and a pair of upper walls 13A, 13B on top of each other. The pair of side walls 12A, 12B include a right side wall 12A and a left side wall 12B. The pair of upper walls 13A, 13B include a first upper wall 13A joined to the right side wall 12A, and a second upper wall 13B joined to the left side wall 12B. The upper walls 13A, 13B are divided into a front end upper wall 13F and a rear end upper wall 13R. In the front end upper wall 13F, the second upper wall 13B is located on the lower side and the first upper wall 13A is located on the upper side. In the rear end upper wall 13R, contrary to the front end upper wall 13F, the first upper wall 13A' is located on the lower side and the second wall 13B' is located on the upper side.

The contact 10 has a lance 20, as shown in FIGS. 1A-3C. The lance 20 has a cantilever shape and extends from the front end upper wall 13F to the rear R. The lance 20 has a rear end portion 20A with a catch portion 21 that, when inserted into a connector housing, is caught in the connector housing for pull-out prevention.

Figure 2:
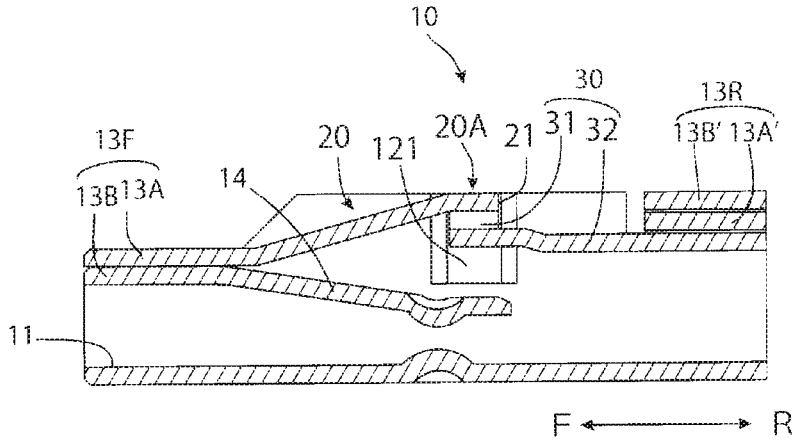
FIG. 2 is a sectional side view of the contact, taken along line Z-Z of FIG. 1A.
Figures 3A, 3B, 3C:
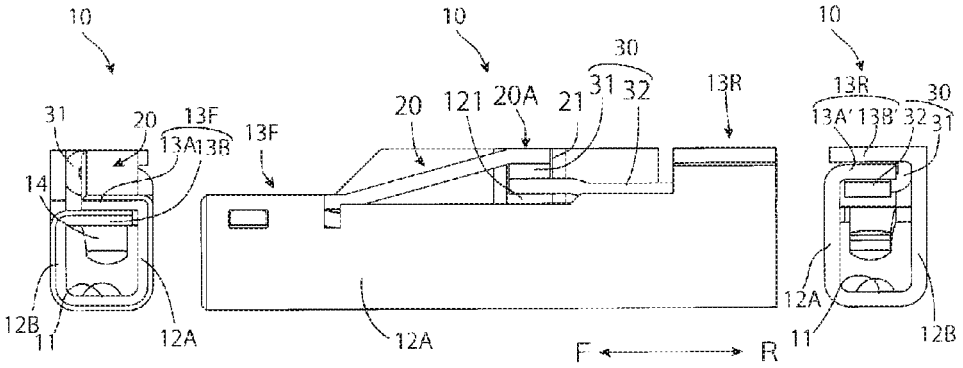
FIG. 3A is a front view of the contact of FIG. 1A.
FIG. 3B is a side view of the contact of FIG. 1A.
FIG. 3C is a rear view of the contact of FIG. 1A.

As shown in FIGS. 1A-3C, the front end upper wall 13F has the upper walls 13A, 13B on top of each other. The lance 20 is connected to the first upper wall 13A, which is located on the upper side, of the pair of upper walls 13A, 13B, and extends from the first upper wall 13A. As shown in FIG. 2, a contact beam 14 that contacts a contact of a mating connector extends from the second upper wall 13B, which is located on the lower side, of the pair of upper walls 13A, 13B. By extending the lance 20 from the first upper wall 13A, a space in which to position the contact beam 14 is secured under the lance 20.

The first upper wall 13A is formed by folding back the side wall 12A, and the lance 20 is formed on an extension of the first upper wall 13A. As a result, the contact 10 is structured to bring about improvement in yield.

An extension piece 30 is provided further behind the rear end portion 20A of the lance 20 in the rearward direction R, as shown in FIGS. 1A-3C. The extension piece 30 has a folded-back portion 31 folded back downward from the rear end portion 20A continuously lateral to the rear end portion 20A of the lance 20 and further folded back so as to be located under the rear end portion 20A. In order to secure a space in which to position the folded-back portion 31, a depressed portion 121 is formed in an inner wall surface of the left side wall 12B. The extension piece 30 has an extension portion 32 that continuously extends farther rearward from the folded-back portion 31 to be positioned under the rear end upper wall 13R. The formation of the folded-back portion 31 forms a difference in level between the rear end portion 20A of the lance 20 and the extension portion 32 extending to the rear of the extension piece 30. The difference in level secures a space that is needed as a margin by which the catch portion 21 is caught in the connector housing.

In the contact 10, the extension piece 30 is formed by extending the lance 20, and the extension portion 32 of the extension piece 30 is placed under the rear end upper wall 13R. This makes it difficult for the electric wire to get under the lance 20. Further, even if the electric wire gets into a space under the rear end portion 20A of the lance 20, an accident in which the lance 20 deforms by being lifted by the electric wire is prevented.

The rear end upper wall 13R is constituted by the pair of upper walls 13A', 13B' on top of each other, as shown in FIGS. 1A-3C. The extension portion 32 is placed under the first upper wall 13A', which is located on the lower side, of the pair of upper walls 13A', 13B'. In inserting the contact 10 into the connector housing, the lance 20 elastically deforms by being pressed once from above by the connector housing. The extension piece 30 is integrally connected with the lance 20. For this reason, when the lance 20 elastically deforms, the extension piece 30 needs to be displaced downward. The extension portion 32 of the extension piece 30 is placed under the first upper wall 13A', which renders the extension piece 30 displaceable.

What is claimed is:

1. A contact, comprising:

a pair of side walls;

a front end upper wall extending from the side walls;

a rear end upper wall extending from the side walls;

a lance extending in a rearward direction from a rear end of the front end upper wall, the lance has a catch portion at a rear end portion of the lance, the catch portion is caught in a housing when the contact is inserted into the housing; and an extension piece extending in the rearward direction from the rear end portion of the lance, the extension piece positioned under the rear end upper wall, the extension piece has a folded-back portion folded downward from the rear end portion in a direction lateral to the rear end portion.

2. The contact of claim 1, wherein the folded-back portion is folded under the rear end portion.

3. The contact of claim 1, wherein the pair of side walls include a right side wall and a left side wall on opposite sides of the lance.

4. The contact of claim 3, wherein the front end upper wall and the rear end upper wall each include a pair of upper walls with a first upper wall and a second upper wall.

5. The contact of claim 4, wherein the first upper wall extends from the right side wall and the second upper wall extends from the left side wall.

6. The contact of claim 5, wherein the first upper wall is positioned on top of the second upper wall at the front end upper wall.

7. The contact of claim 6, wherein the second upper wall is positioned on top of the first upper wall at the rear end upper wall.

8. The contact of claim 7, wherein the extension piece is disposed under the first upper wall at the rear end upper wall.

9. The contact of claim 6, wherein the lance extends in the rearward direction from the first upper wall at the front end upper wall.

10. The contact of claim 9, further comprising a contact beam extending in the rearward direction from the second upper wall at the front end upper wall.

11. The contact of claim 10, further comprising a bottom wall connecting the right side wall and the left side wall, the contact beam is positioned between the bottom wall and the lance.

12. The contact of claim 1, wherein the extension piece is integrally connected with the lance.

13. The contact of claim 1, wherein one of the side walls has a depressed portion in an inner wall surface.

14. The contact of claim 13, wherein the folded-back portion is positioned in the depressed portion.

15. A contact, comprising:

a pair of side walls;

a front end upper wall extending from the side walls;

a rear end upper wall extending from the side walls, the front end upper wall and the rear end upper wall each include a pair of upper walls with a first upper wall and a second upper wall;

a lance extending in a rearward direction from a rear end of the front end upper wall, the lance has a catch portion at a rear end portion of the lance, the catch portion is caught in a housing when the contact is inserted into the housing, the pair of side walls include a right side wall and a left side wall on opposite sides of the lance; and an extension piece extending in the rearward direction from the rear end portion of the lance, the extension piece positioned under the rear end upper wall.

16. The contact of claim 15, wherein the first upper wall extends from the right side wall and the second upper wall extends from the left side wall.

17. The contact of claim 16, wherein the first upper wall is positioned on top of the second upper wall at the front end upper wall.

18. The contact of claim 17, wherein the second upper wall is positioned on top of the first upper wall at the rear end upper wall.

19. The contact of claim 18, wherein the extension piece is disposed under the first upper wall at the rear end upper wall.

20. The contact of claim 17, wherein the lance extends in the rearward direction from the first upper wall at the front end upper wall.

21. The contact of claim 20, further comprising a contact beam extending in the rearward direction from the second upper wall at the front end upper wall.

22. The contact of claim 21, further comprising a bottom wall connecting the right side wall and the left side wall, the contact beam is positioned between the bottom wall and the lance.

* * * * *